US011181332B2

(12) United States Patent
Kasanjian-King

(10) Patent No.: US 11,181,332 B2
(45) Date of Patent: Nov. 23, 2021

(54) TAKEDOWN PIN FOR A RIFLE

(71) Applicant: Juggernaut Tactical, Inc., Orange, CA (US)

(72) Inventor: Zackary Kasanjian-King, Corona, CA (US)

(73) Assignee: JUGGERNAUT TACTICAL, INC., Orange, CA (US)

( * ) Notice: Subject to any disclaimer, the term of this patent is extended or adjusted under 35 U.S.C. 154(b) by 0 days.

(21) Appl. No.: 15/930,537

(22) Filed: May 13, 2020

(65) Prior Publication Data

US 2020/0300564 A1 Sep. 24, 2020

Related U.S. Application Data

(63) Continuation of application No. 16/419,301, filed on May 22, 2019, now Pat. No. 10,684,083, which is a continuation of application No. 16/043,032, filed on Jul. 23, 2018, now Pat. No. 10,337,810.

(60) Provisional application No. 62/543,101, filed on Aug. 9, 2017, provisional application No. 62/637,168, filed on Mar. 1, 2018.

(51) Int. Cl.

| | |
|---|---|
| ***F41A 3/66*** | (2006.01) |
| ***F41A 11/00*** | (2006.01) |
| ***F41A 17/38*** | (2006.01) |

(52) U.S. Cl.
CPC ..... *F41A 3/66* (2013.01); *F41A 11/00* (2013.01); *F41A 17/38* (2013.01)

(58) Field of Classification Search
CPC ..... F41A 3/66
See application file for complete search history.

(56) References Cited

U.S. PATENT DOCUMENTS 10,101,107 B1 10/2018 Huang et al.
10,684,083 B2 * 6/2020 Kasanjian-King ..... F41A 11/00

* cited by examiner

*Primary Examiner* — Reginald S Tillman, Jr.
(74) *Attorney, Agent, or Firm* — Bennet K. Langlotz; Langlotz Patent & Trademark Works, LLC

(57) ABSTRACT

Takedown pins for rifles have a pin movable in a direction along its length between an operating condition and a released condition. The pin has a first end portion that prevents relative movement of the upper receiver with respect to the lower receiver when the pin is in the operating condition. The first end portion has a lower end portion surface adapted to resist upward movement of the upper receiver's lug. The pin has an intermediate portion adjacent to the lower end portion surface defining a lower channel having a lower channel surface above the level of the lower end portion surface. When the pin is in the released condition, the lower channel is registered with the lug, and the lug is enabled to move upward with respect to the lower receiver by a limited distance to a disengaged position.

20 Claims, 17 Drawing Sheets

TAKEDOWN PIN FOR A RIFLE

CROSS-REFERENCE TO RELATED APPLICATION

This application is a Continuation of U.S. patent application Ser. No. 16/419,301 filed on May 22, 2019, entitled "TAKEDOWN PIN FOR A RIFLE," which is a Continuation of U.S. patent application Ser. No. 16/043,032 filed on Jul. 23, 2018, now issued as U.S. Pat. No. 10,337,810, entitled "TAKEDOWN PIN FOR A RIFLE," which claims the benefit of U.S. Provisional Patent Application No. 62/543,101 filed on Aug. 9, 2017, entitled "QUICK RELEASE TAKEDOWN PIN," and also claims the benefit of U.S. Provisional Patent Application No. 62/637,168 filed on Mar. 1, 2018, entitled "QUICK RELEASE TAKEDOWN PIN AND MAG LOCK," which are hereby incorporated by reference in their entirety for all that is taught and disclosed therein.

FIELD OF THE INVENTION

The present invention relates to firearms, and more particularly to a takedown pin for a rifle for firearms.

BACKGROUND OF THE INVENTION

A magazine is an ammunition storage and feeding device within, or attached to, a repeating firearm. The magazine functions by moving the cartridges stored in the magazine into a position where they may be chambered by the action of the firearm. Most magazines designed for use with a reciprocating bolt firearm utilize a set of feed lips which stops the vertical motion of the cartridges out of the magazine but allows one cartridge at a time to be pushed forward (stripped) out of the feed lips by the firearm's bolt into the chamber.

Some form of spring and follower combination is almost always used to feed cartridges to the lips, which can be located either in the magazine (most removable box magazines) or built into the firearm (fixed box magazines). A box (or "stick") magazine, the most popular type of magazine in modern rifles and handguns, stores cartridges in a straight or gently curved column, either one above the other or staggered zigzag fashion. As the firearm cycles, cartridges are moved to the top of the magazine by a follower driven by spring compression to either a single feed position or alternating feed positions. In most firearms, the magazine follower engages a slide-stop to hold the slide back and keep the firearm out of battery when the magazine is empty and all rounds have been fired. Box magazines may be integral to the firearm or removable.

A detachable box magazine is a self-contained mechanism capable of being loaded or unloaded while detached from the host firearm. They are inserted into a magazine well in the firearm receiver usually below the action, but occasionally positioned to the side or on top. When the magazine is empty, it can be detached from the firearm and replaced by another full magazine while the firearm remains in an operable state. This significantly speeds the process of reloading, allowing the operator quick access to ammunition. This type of magazine may be straight or curved, the curve being necessary if the rifle uses rimmed ammunition or ammunition with a tapered case.

In some jurisdictions, a semi-automatic firearm such as the extremely popular AR-15 rifle, is prohibited to the general public when it is equipped with a conventional detachable box magazine that enables rapid reloading. However, if the semi-automatic firearm is equipped with a fixed magazine that cannot be removed from the firearm unless the firearm is in an inoperable state, the firearm is not prohibited, and is not subject to the associated legal restrictions.

People seeking to develop skills and enjoy the many advances of the AR-15 platform, but who live in jurisdictions where standard versions are prohibited, require a fixed magazine version of the rifle. However, this requires the rifle design to deviate substantially from the conventional format. Moreover, there are challenges with loading a fixed magazine on an AR-15 rifle, including access to the open end of the magazine, and time to load each cartridge. In addition, people prefer to own a rifle that can be adapted to conventional use with detachable magazines in the event the owner leaves the jurisdiction where the prohibition applies. Thus, existing rifles that comply with prohibitions are less desirable when they have configurations or modifications that render them unable to accept conventional detachable magazines.

Therefore, a need exists for a new and improved takedown pin for a rifle that enables a semi-automatic firearm to be opened and closed without requiring complete removal of the takedown pin. In this regard, the various embodiments of the present invention substantially fulfill at least some of these needs. In this respect, the takedown pin for a rifle according to the present invention substantially departs from the conventional concepts and designs of the prior art, and in doing so provides an apparatus primarily developed for the purpose of providing a semi-automatic firearm that can be opened and closed without requiring complete removal of the takedown pin.

SUMMARY OF THE INVENTION

The present invention provides an improved takedown pin for a rifle, and overcomes the above-mentioned disadvantages and drawbacks of the prior art. As such, the general purpose of the present invention, which will be described subsequently in greater detail, is to provide an improved takedown pin for a rifle that has all the advantages of the prior art mentioned above.

To attain this, the preferred embodiment of the present invention essentially comprises an upper receiver having a downwardly depending rear lug having a width, the rear lug defining a transverse lug bore having a selected diameter, a lower receiver removably attachable to the upper receiver, the lower receiver defining an upwardly open cavity defined between opposed sidewalls, the cavity adapted to receive the lug when the upper receiver is connected to the lower receiver, the sidewalls defining lateral sidewall bores having the selected diameter, the sidewall bores being registered with the lug bore when the upper receiver and lower receiver are in a fully engaged condition, a pin having an elongated portion received in the lug bore and the sidewall bores, the pin being movable in a direction along its length between an operating condition and a released condition, the pin having a first end portion that, when the pin is in the operating condition, is closely received in at least one of the sidewall bores and is closely received within at least a portion of the lug bore such that relative movement of the upper receiver with respect to the lower receiver is prevented, the first end portion having a lower end portion surface adapted to resist upward movement of the lug, the pin having an intermediate portion adjacent to the lower end portion surface, the intermediate portion of the pin defining a lower channel having a lower channel surface above the level of the lower end portion surface, and the lower channel having a width at least as great as the width of the lug, such that when the pin is in the released condition, the lower channel is registered with the lug, and the lug is enabled to move upward with respect to the lower receiver by a limited distance to a disengaged position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
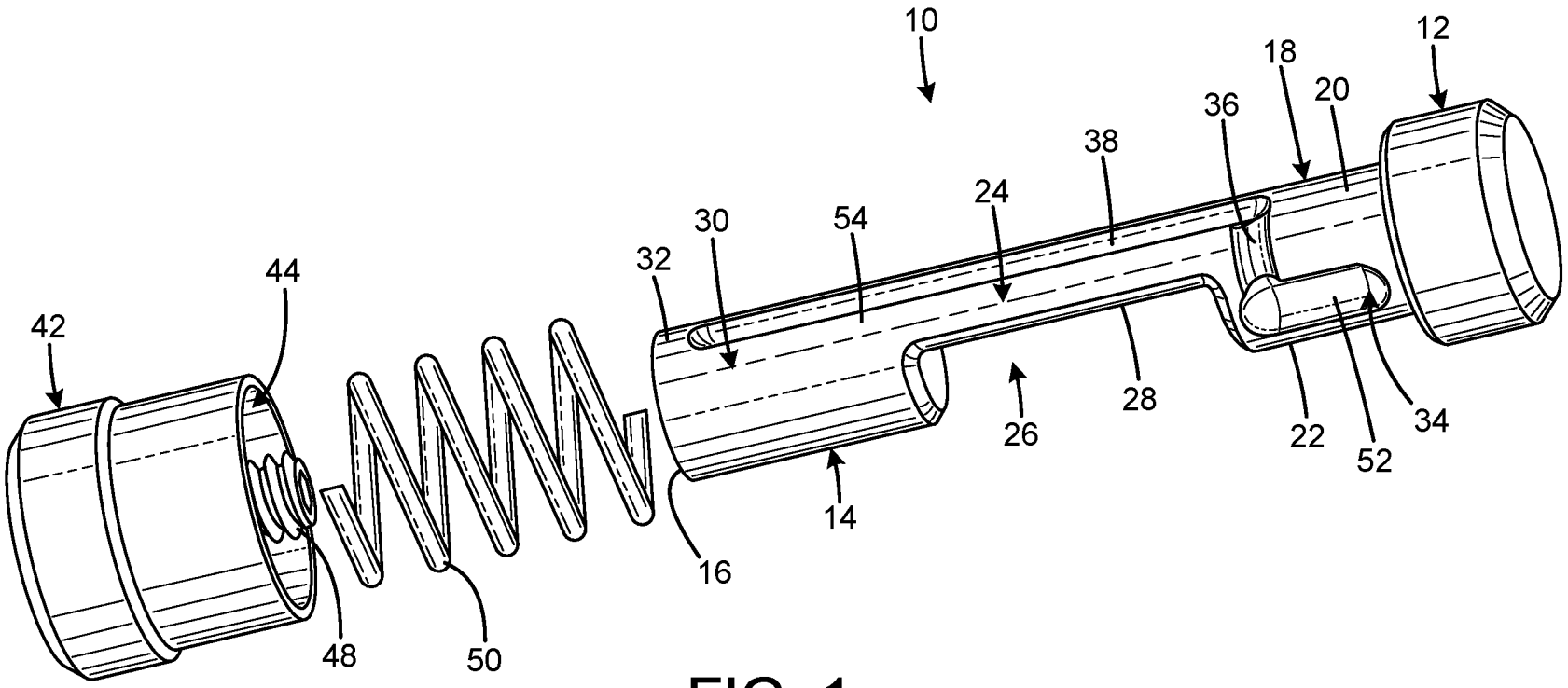
FIG. 1 is an isometric view of the current embodiment of the takedown pin for a rifle constructed in accordance with the principles of the present invention.

An embodiment of the takedown pin for a rifle of the present invention is shown and generally designated by the reference numeral 10.

FIG. 1 illustrates the improved takedown pin for a rifle 10 of the present invention. More particularly, the takedown pin for a rifle 10 has a right head 12 and an elongated portion 14 terminating in a left end 16. The elongated portion includes a cylindrical first end portion 18 abutting the right head, an intermediate portion 24, and a second end portion 30 terminating in the left end. The first end portion has an exterior surface 20 and lower end portion surface 22. The takedown pin has an intermediate portion 24 adjacent to the lower end portion surface. The intermediate portion has an upper surface 54 coextensive with the first end portion and defines a lower channel 26 opposite the upper surface having a lower channel surface 28 above the level of the lower end portion surface. The takedown pin has a cylindrical second end portion 30 adjacent to the intermediate portion. The second end portion has an exterior surface 32 and has the same diameter as the first end portion.

The elongated portion 14 of the takedown pin for a rifle 10 defines a detent channel 34. The detent channel has an operating portion 52 located on the exterior surface 20 of the first end portion 18 that is parallel to the elongated portion. The detent channel has a transition portion 36 located on the exterior surface of the first end portion. The transition portion is connected to and perpendicular to the operating portion. The detent channel has a takedown portion 38 located on the exterior surface of the first end portion, the upper surface 54 of the intermediate portion 24, and the exterior surface 32 of the second end portion 30. The takedown portion is connected to and perpendicular to the transition portion.

Figure 2:
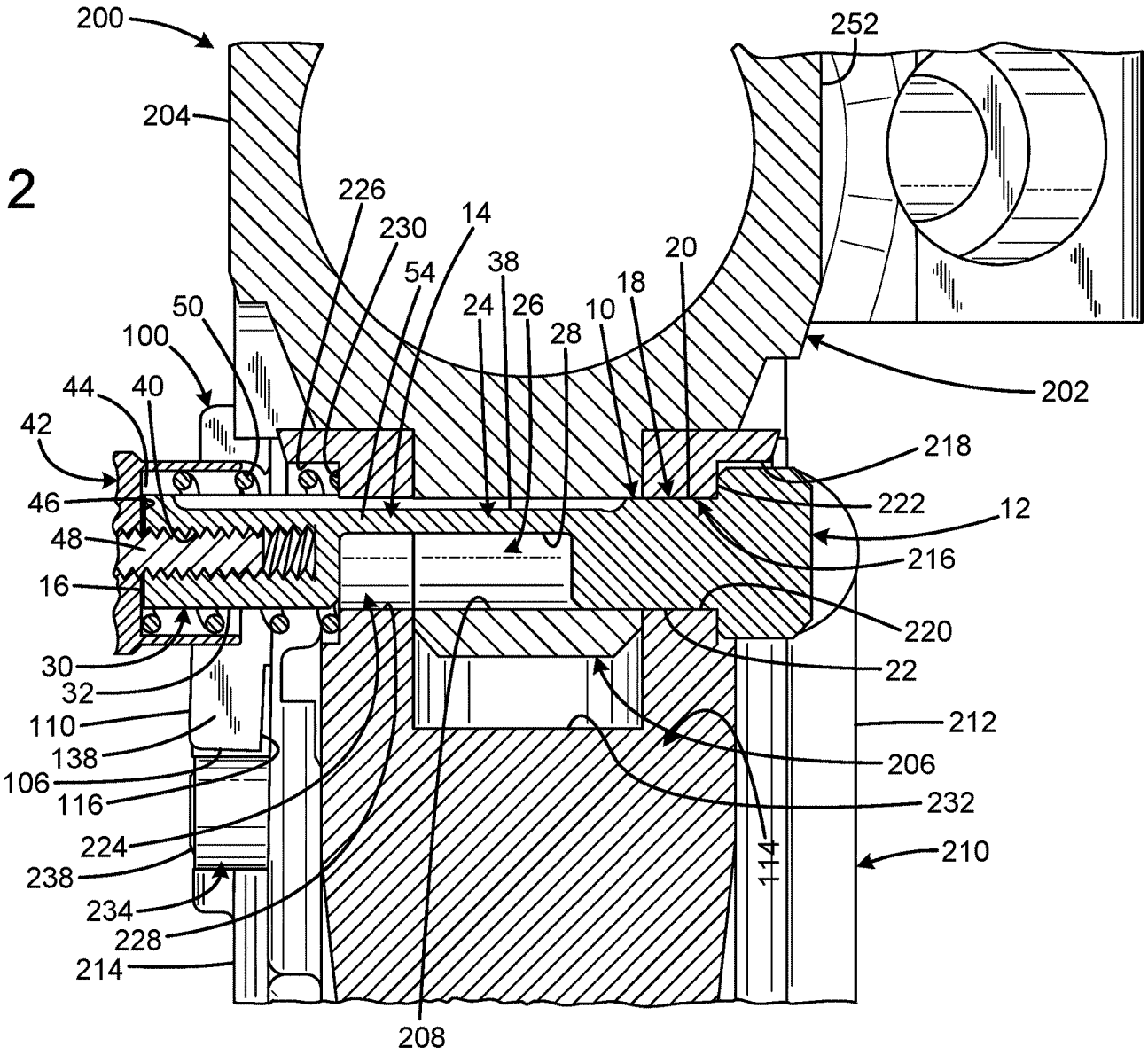
FIG. 2 is a rear sectional view of the takedown pin for a rifle of FIG. 1 installed in a rifle in the operating condition.

The left end 16 of the elongated portion 14 of the takedown pin for a rifle 10 defines a threaded aperture 40 (shown in FIG. 2). A removable left cap 42 has an interior 44 that receives a screw 48 protruding from the bottom surface 46 (shown in FIG. 2) of the left cap and a circular coil spring 50. When the takedown pin is assembled, the screw is threaded into the threaded aperture until the left end of the elongated portion abuts the bottom surface of the left cap.

FIGS. 2-5 illustrate the improved takedown pin for a rifle 10 of the present invention. More particularly, the takedown pin for a rifle 10 is shown installed in a rifle 200. The rifle has an upper receiver 202 having a left side wall 204, right side wall 252, and a rear lug 206 having a selected diameter. The rear lug defines a transverse lug bore 208. The rifle also has a lower receiver 210 having a right side wall 212 and left side wall 214. The right side wall 212 defines a right side wall bore 216 having the selected diameter that includes an enlarged portion 218 sized to closely receive the right head 12 of the takedown pin for a rifle 10, a narrow portion 220 sized to closely receive the elongated portion 14 of the takedown pin, and a shoulder 222 to prevent the right head from entering the narrow portion. The left side wall 214 defines a left side wall bore 224 having the selected diameter that includes an enlarged portion 226 sized to closely receive the left cap 42 of the takedown pin, a narrow portion 228 sized to closely receive the elongated portion of the takedown pin, and a shoulder 230 sized to prevent the left cap from entering the narrow portion. The lower receiver also defines an upwardly open cavity 232 located between the left and right side walls. The upwardly open cavity is sized and positioned to closely receive the rear lug when the rifle is assembled.

Figure 3:
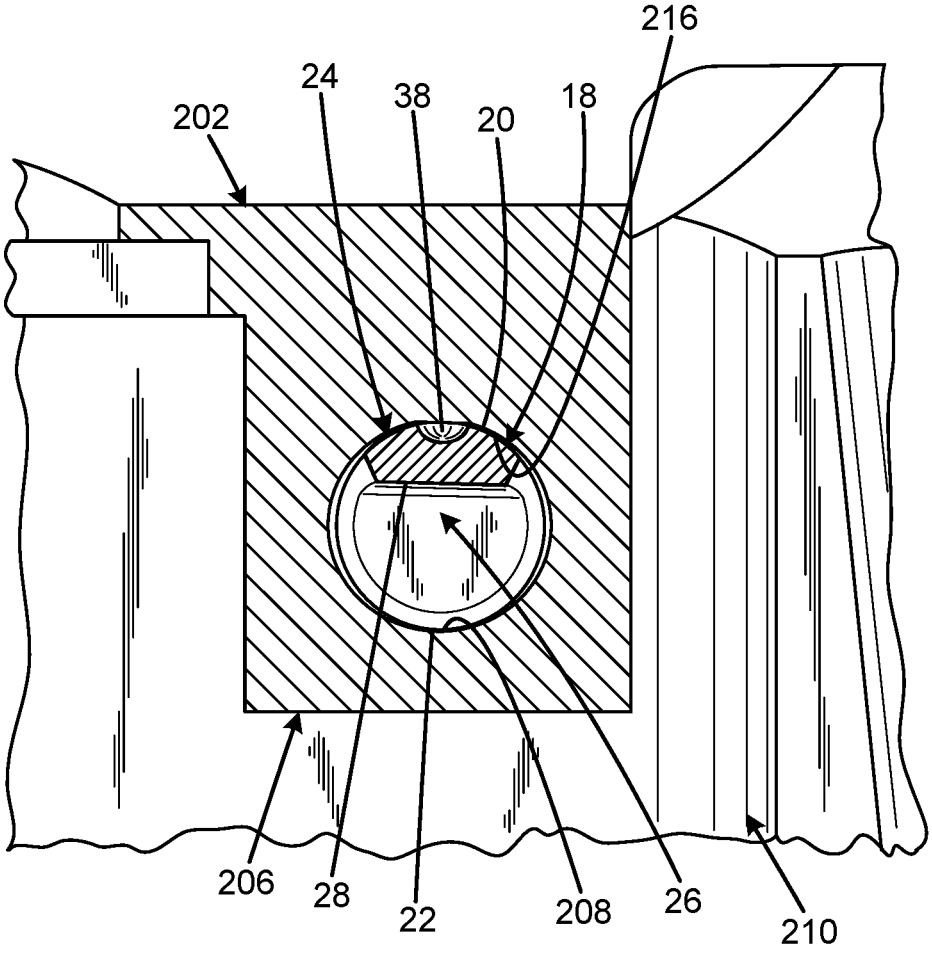
FIG. 3 is a side sectional view of the takedown pin for a rifle of FIG. 1 installed in a rifle in the operating condition.

In FIGS. 2 and 3, the takedown pin for a rifle 10 is shown in the operating condition. The upper receiver 202 and lower receiver 210 are closed together with the rear lug 206 received in the upwardly open cavity 232 such that the transverse lug bore 208 is axially registered with the right side wall bore 216 and left side wall bore 224. The first end portion 18 of the takedown pin is closely received in the right side wall bore and at least a portion of the transverse lug bore such that relative movement of the upper receiver with respect to the lower receiver is prevented. The lower end portion surface 22 of the first end portion is adapted to resist upward movement of the rear lug. It should be appreciated that the coil spring 50 is captured between the bottom surface 46 of the left cap and the shoulder 230 to bias the takedown pin such that the right head 12 is urged against the shoulder 222 to bias the takedown pin towards the operating condition.

Figure 4:
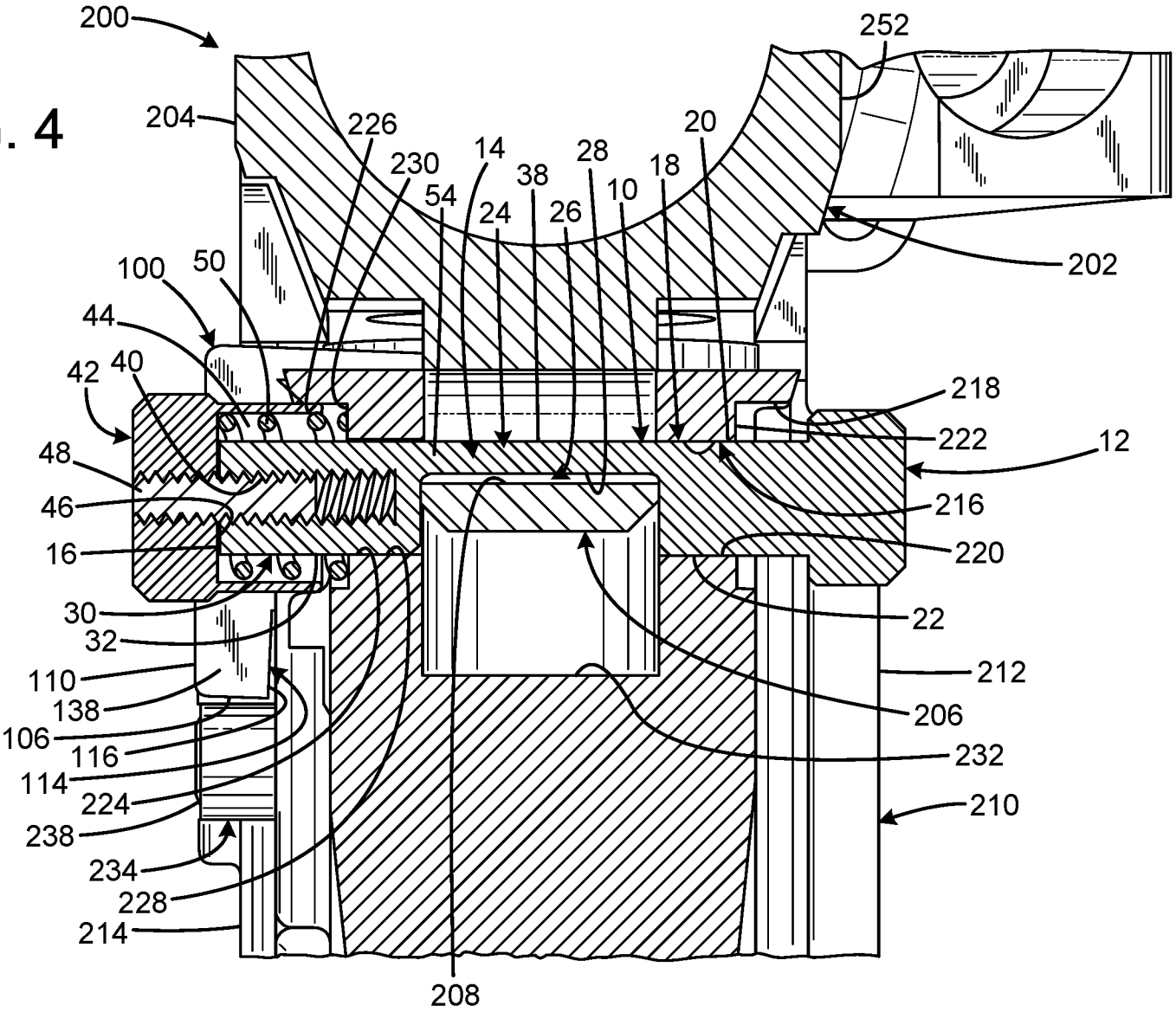
FIG. 4 is a rear sectional view of the takedown pin for a rifle of FIG. 1 installed in a rifle in the released condition.
Figure 5:
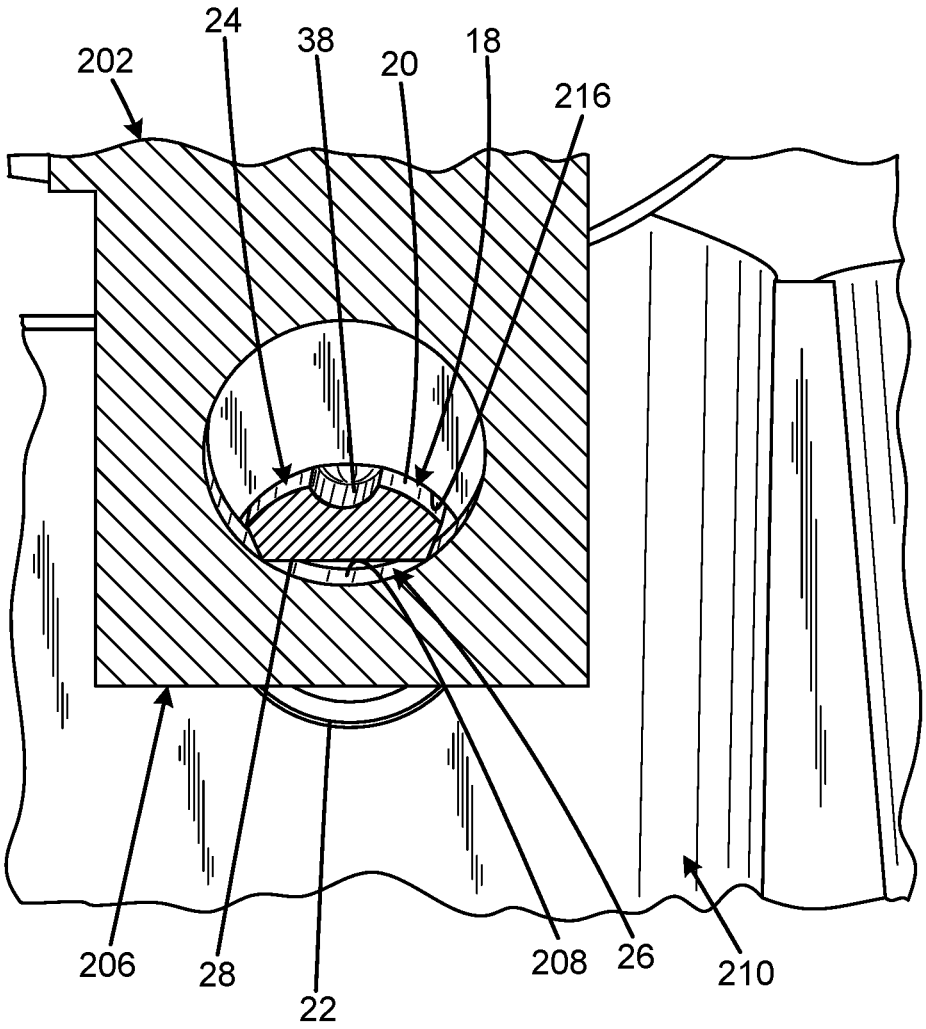
FIG. 5 is a side sectional view of the takedown pin for a rifle of FIG. 1 installed in a rifle in the released condition.

In FIGS. 4 and 5, the takedown pin for a rifle 10 is shown in the released condition. The takedown pin has been moved to the right along its length to transition from the operating condition shown in FIGS. 2 and 3 to the released condition. The lower channel 26 has a width at least as great as the width of the lug such that when the takedown pin is in the released condition, the lower channel is registered with the rear lug 206, and the lug is enabled to move upward with respect to the lower receiver by a limited distance to the disengaged position illustrated. In the current embodiment, the lug has a width of 0.494", and the lower channel has a margin of 0.012", which provides a total lower channel width of 0.506". The upward motion of the lug is limited by the lower channel surface 28, which is flat in the current embodiment. When the lug is in the disengaged position, the rifle 200 is inoperable. The rifle can be made operable again by returning the lug to the engaged position shown in FIG. 2 such that the transverse lug bore 208 is axially registered with the right side wall bore 216 and left side wall bore 224. This alignment enables the coil spring 50 to move the takedown pin to the left along its length to transition from the released condition to the operating condition to resist upward movement of the rear lug. In the current embodiment, the intermediate portion has a length of at least the lug width of 0.494" plus a tolerance of 0.012" for a total length of 0.506", a diameter of 0.248", and a vertical thickness of 0.070", which is 28.2% of the diameter of the elongated portion 14. Thus, the intermediate portion has a cross-sectional profile having an area less than or equal to 28.2% of the cross-sectional area. However, the cross-sectional profile can have a different area percentage to prioritize strength or reliable operation/tolerance. The intermediate portion has a consistent cross-sectional profile along its length. The upper surface 54 of the intermediate portion is coextensive with the end portion surfaces 20, 32 and has a cylindrical profile corresponding to the end portion surfaces. The lower channel surface is spaced above the cylindrical profile of the upper surface.

Figure 6:
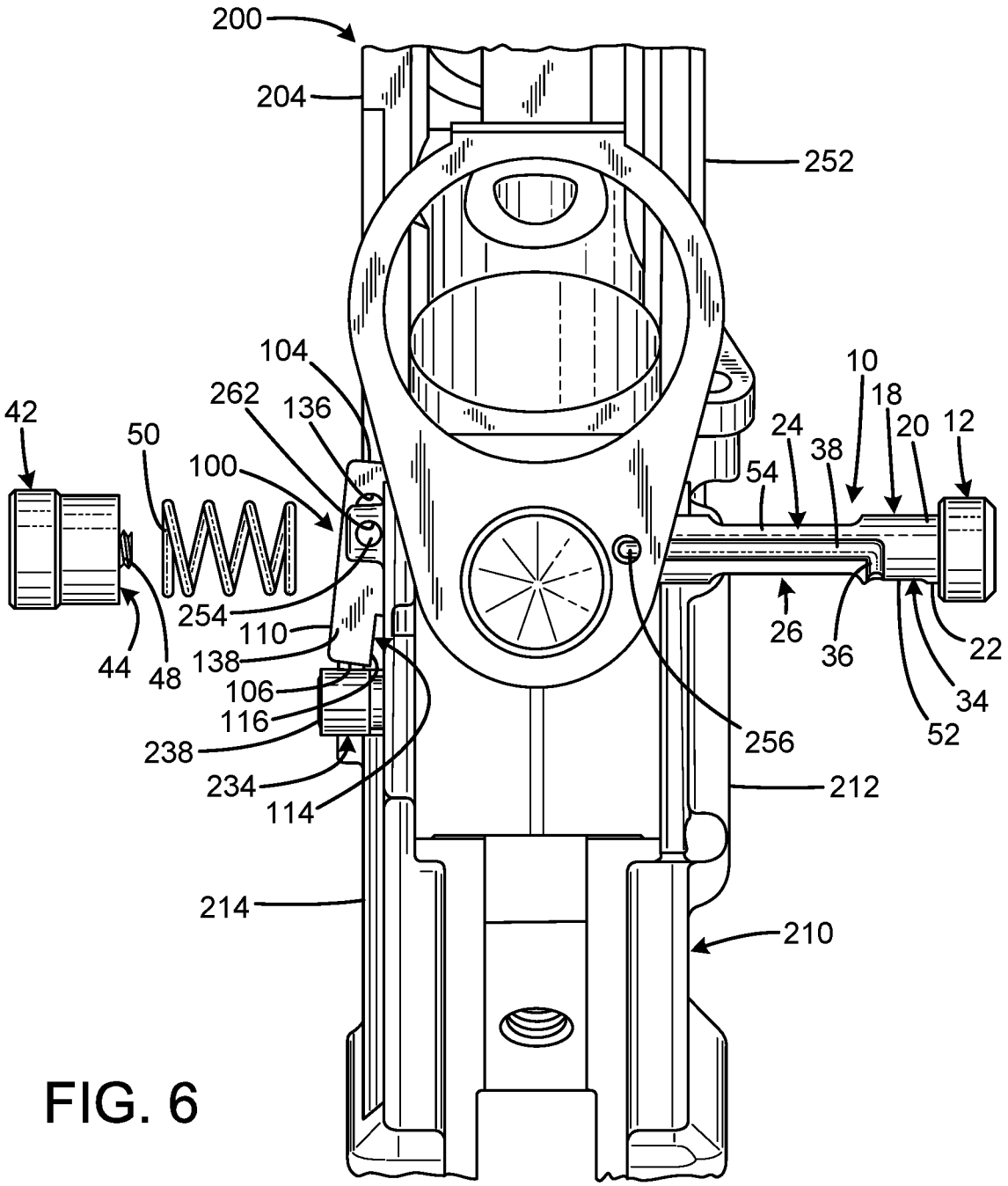
FIG. 6 is a rear view of the takedown pin for a rifle of FIG. 1 in the process of being removed from a rifle.

In FIG. 6, the takedown pin for a rifle 10 is shown in the process of being uninstalled from the rifle 200. The lower receiver 210 includes a detent 256 that is received within the operating portion 52 of the detent channel 34 during normal use of the rifle with the takedown pin installed. The operating portion limits motion of the takedown pin to reciprocation between the operating condition and the released condition. To uninstall the takedown pin, the detent is moved into the transition portion of the detent channel to enable rotation of the takedown pin. Subsequently, the detent is moved into the takedown portion of the detent channel. If the detent is in place, the detent will prevent the takedown pin from being removed completely. The takedown pin will stop at the point where the left end 16 of the pin is flush with the inside of the right wall 214 of the lower receiver. In this position, the takedown pin is completely out of the way to permit complete separation of the upper receiver from the lower receiver. This is the same position a standard takedown pin will be if pulled out to the detent stop. To enable extraction of the pin from the lower receiver, the detent needs to be removed, or a sharp pointed pin needs to be inserted along the detent channel to push the detent out of the way. The procedure is reversed to reinstall the takedown pin in the lower receiver.

Figure 7:
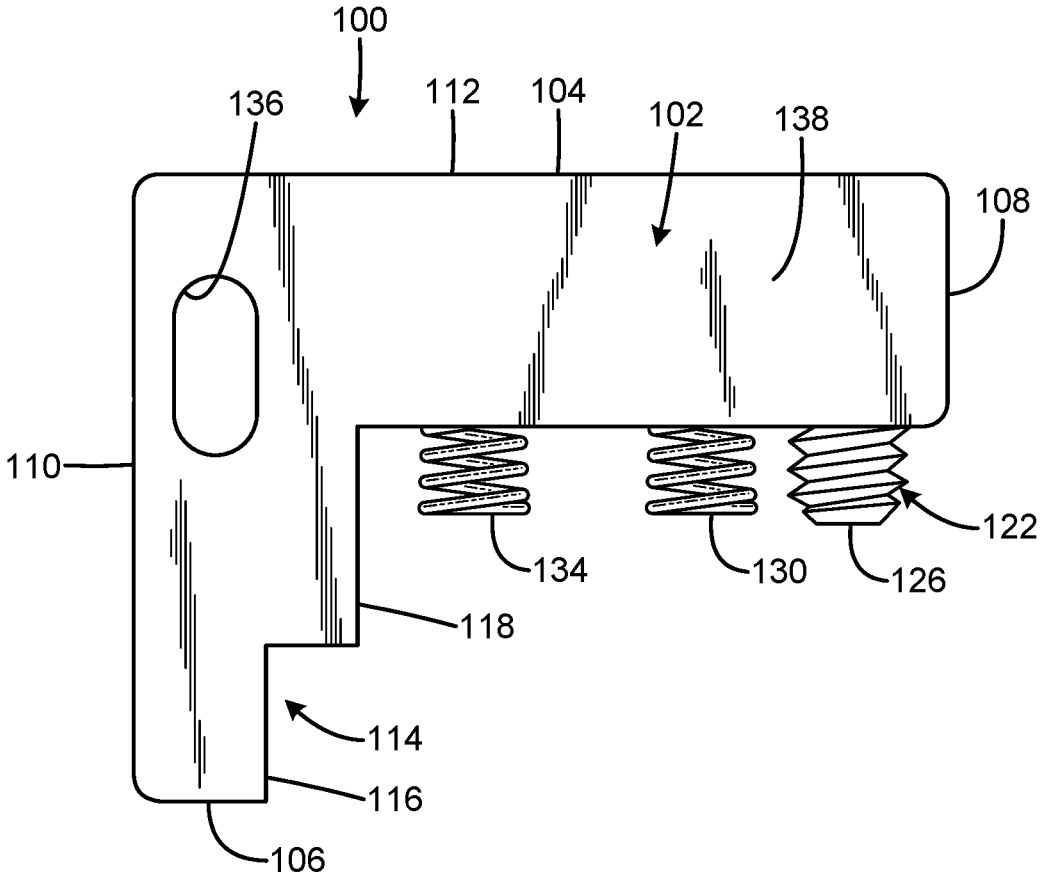
FIG. 7 is a rear view of the current embodiment of the latch for a rifle constructed in accordance with the principles of the present invention.

FIG. 7 illustrates the improved latch for a rifle 100 of the present invention. More particularly, the latch for a rifle 100 has an L-shaped body 102 having a top 104, bottom 106, right end 108, left end 110, and rear 138. The top left of the latch defines an actuator surface 112. The bottom of the latch defines a cutout 114 and a block surface 116. The bottom of the latch also defines a plunger surface 118 immediately above the cutout. The right end of the body defines a vertical threaded set screw aperture 120 (shown in FIGS. 10-17) that extends from the top of the body to the bottom and receives a set screw 122. The set screw has a head 124 (shown in FIGS. 10-17) accessible from the top of the body and a downwardly protruding contact surface 126. Thus, the set screw is movable within an adjustment range that determines the amount of protrusion of the contact surface. The middle of the body between the set screw aperture and the plunger surface defines a right spring bore 128 and a left spring bore 132 (shown in FIGS. 10-17). The right spring bore receives a right circular coil spring 130, and the left spring bore receives a left circular coil spring 134. The coil springs protrude from the spring bores to bias the body in an upward direction. The left end of the body defines a vertical elongated aperture 136.

Figure 8:
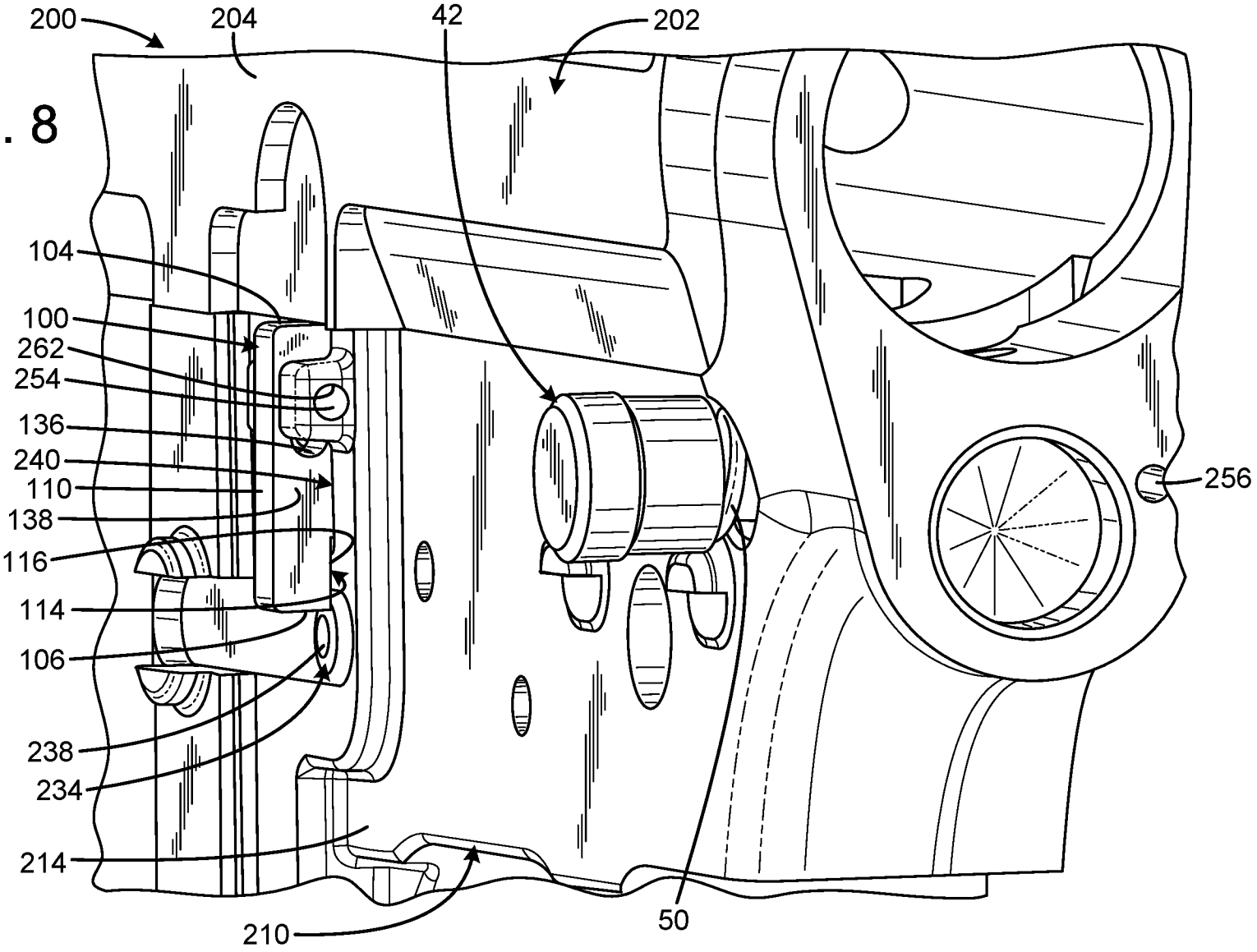
FIG. 8 is an isometric view of the takedown pin for a rifle of FIG. 1 and the latch for a rifle of FIG. 7 installed in a rifle with the bolt catch removed with the latch in the retention position.
Figure 10:
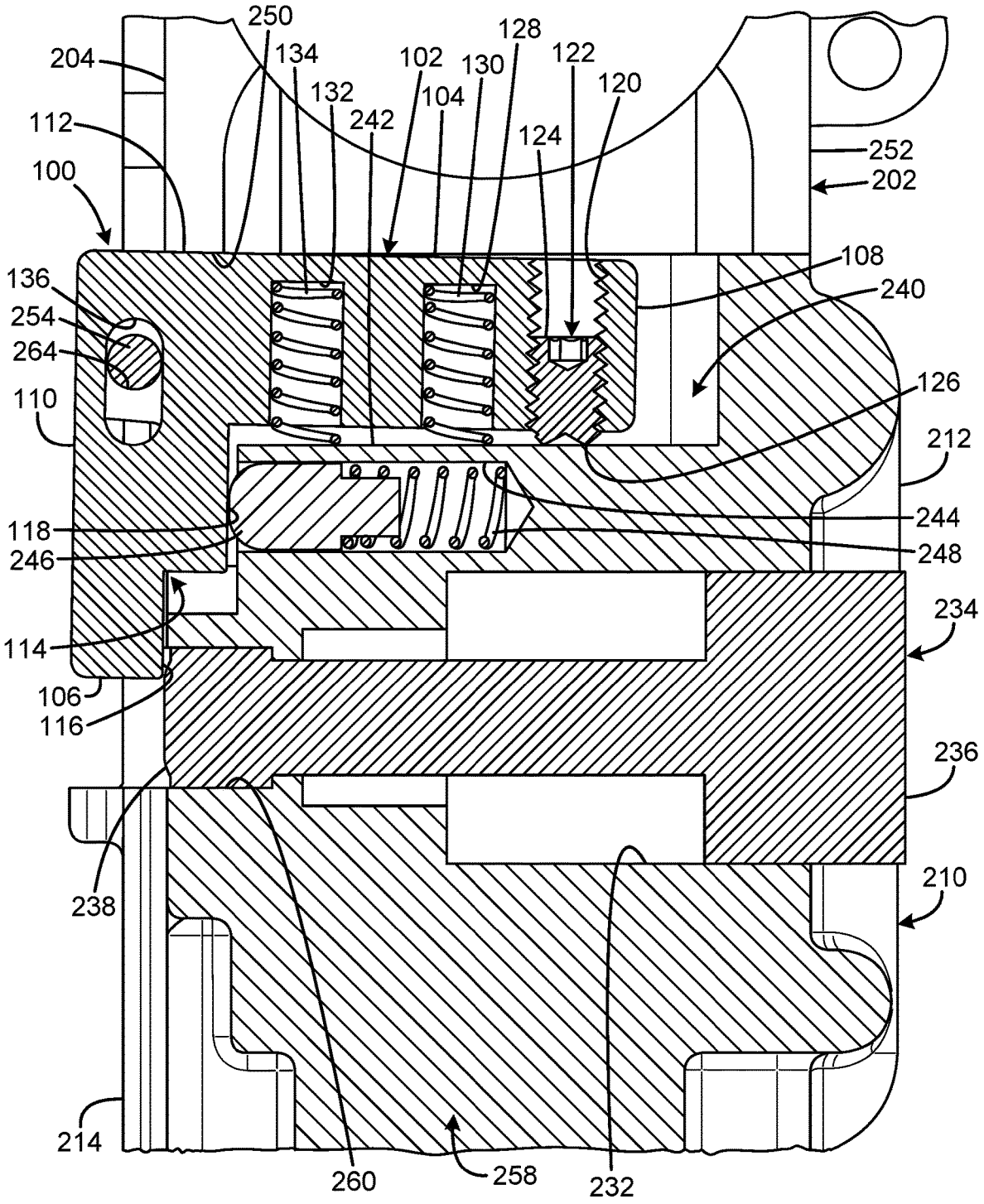
FIG. 10 is a rear sectional view of the latch for a rifle of FIG. 7 installed in a rifle with in-specification bolt hold open latch pin holes in the retention position with a properly adjusted set screw.

FIGS. 8 and 10 illustrate the improved latch for a rifle 100 of the present invention. More particularly, the latch for a rifle 100 is shown installed in a rifle 200 having in-specification bolt hold open latch pin holes 262, 264. The latch for a rifle 100 is shown installed in the bolt hold open latch slot 240 of a rifle 200 with a bolt hold open latch pin 254 received by the bolt hold open latch pin holes on the lower receiver 210 received in the elongated aperture 136. Thus, the elongated aperture serves as a connection facility adapted to connect the body 102 of the latch to the lower receiver such that the pivotal and vertical movement of the body is enabled. The rifle's bolt hold open latch (not shown) has been removed to enable installation of the latch 100, which is a planar element having a limited thickness adapted to be received in the bolt hold open latch slot defined in the lower receiver. The rifle is shown in the closed and operational assembled condition with the latch in the retention position. Contact by the bottom 250 of the left side wall 204 of the upper receiver 202 with the actuator surface 112 of the latch has pushed the latch downward and compressed the left and right springs 130, 134 against the upwardly facing surface 242 of the bolt hold open latch slot. The downward movement of the latch also causes the plunger surface 118 to push inward against plunger 246 and compress spring 248 within plunger aperture 244. The set screw 122 has been properly adjusted so that when the latch is pushed downward into the retention position, the block surface 116 prevents movement of the magazine release 234 from the retention position to the released position by obstructing the magazine catch 238. As a result, a magazine 258 installed in the rifle cannot be extracted while the rifle is in the operational assembled condition because it is impossible to disengage the magazine catch from the magazine's aperture 260.

Figure 9:
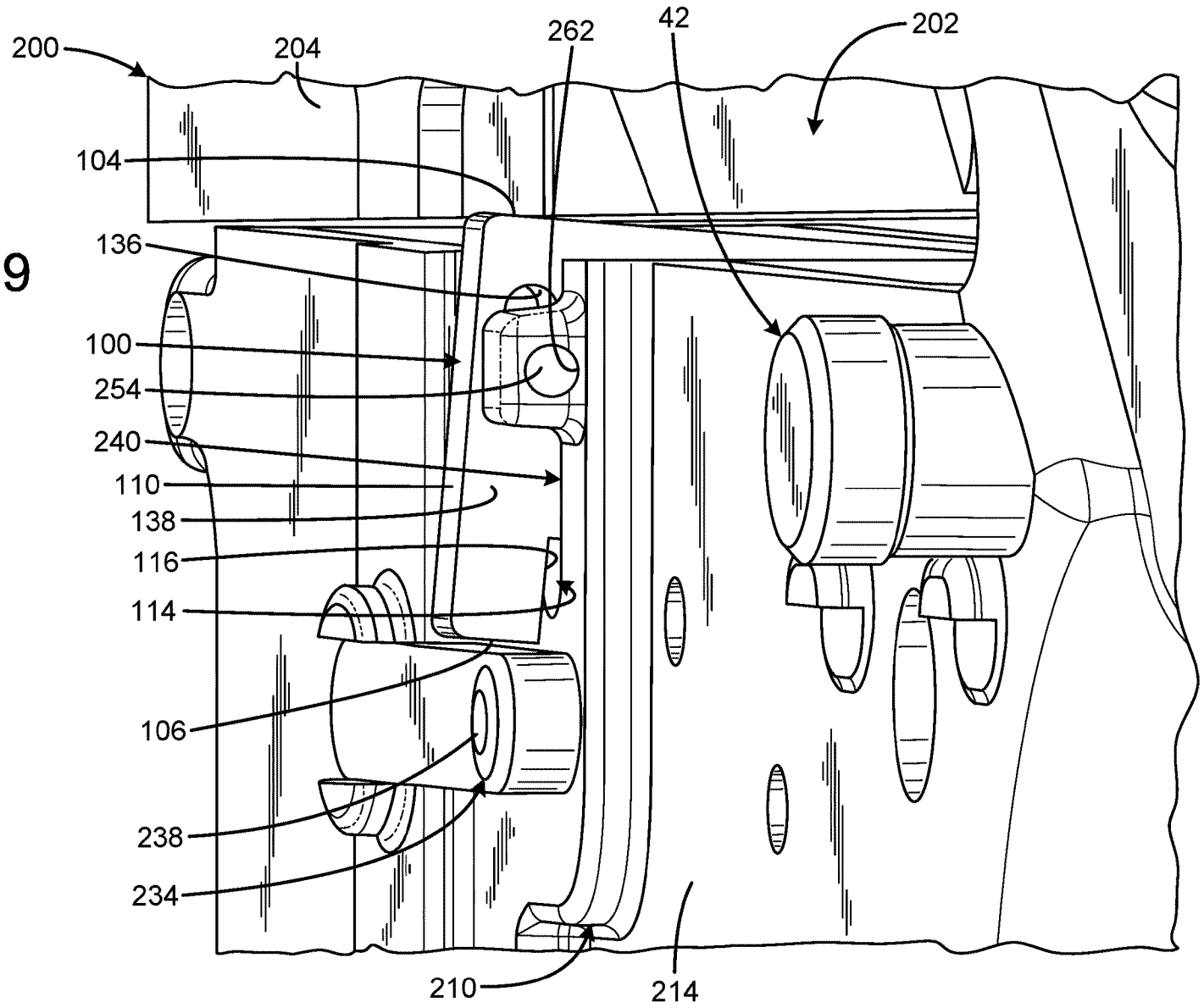
FIG. 9 is an isometric view of the takedown pin for a rifle of FIG. 1 and the latch for a rifle of FIG. 7 installed in a rifle with the bolt catch removed with the latch in the released position.
Figure 11:
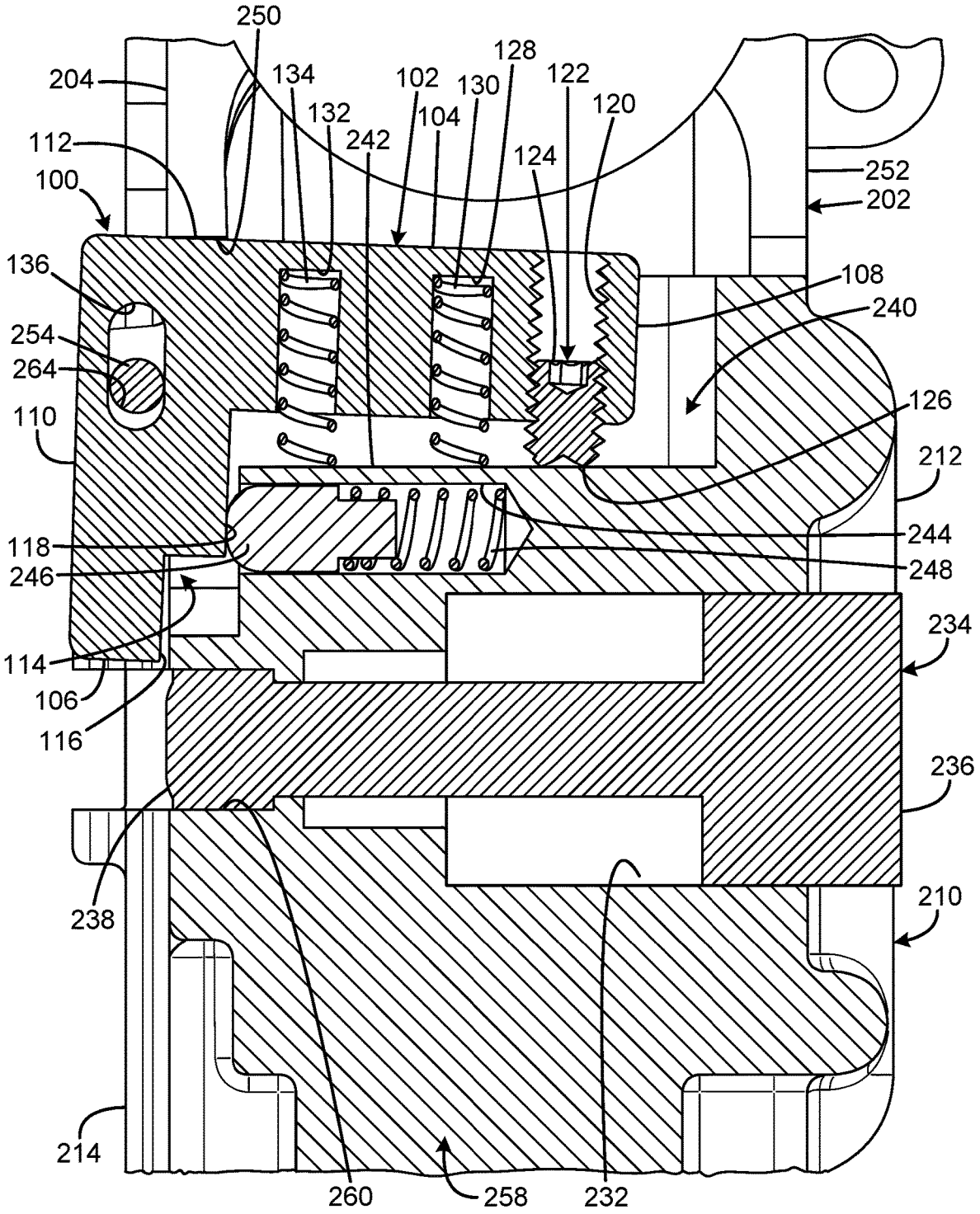
FIG. 11 is a rear sectional view of the latch for a rifle of FIG. 7 installed in a rifle with in-specification bolt hold open latch pin holes in the released position with a properly adjusted set screw.

FIGS. 9 and 11 illustrate the improved latch for a rifle 100 of the present invention. More particularly, the latch for a rifle 100 is shown installed in a rifle 200 having in-specification bolt hold open latch pin holes 262, 264. The latch for a rifle 100 is shown installed in the bolt hold open latch slot 240 of a rifle 200 with a bolt hold open latch pin 254 on the lower receiver 210 received in the elongated aperture 136. The rifle is shown in the open and inoperable separated condition with the latch in the released position. The upper receiver has been raised sufficiently to enable upward movement of the latch until contact by the bottom 250 of the left side wall 204 of the upper receiver 202 with the actuator surface 112 of the latch prevents further upward movement. The left and right springs 130, 134 have pushed against the upwardly facing surface 242 of the bolt hold open latch slot to urge the latch upward. The upward movement of the latch also causes the spring 248 to push the plunger 246 outward against plunger surface 118 to cause a clockwise pivoting of the latch about the bolt hold open latch pin. The set screw 122 has been properly adjusted so that when the latch is permitted to rise upward and outward into the released position, the block surface 116 no longer prevents movement of the magazine release 234 from the retention position to the released position by obstructing the magazine catch 238. As a result, a magazine 258 installed in the rifle can be extracted once the magazine catch is no longer received by the magazine's aperture 260, and a replacement magazine can be installed while the rifle is in the inoperable separated condition.

Figure 12:
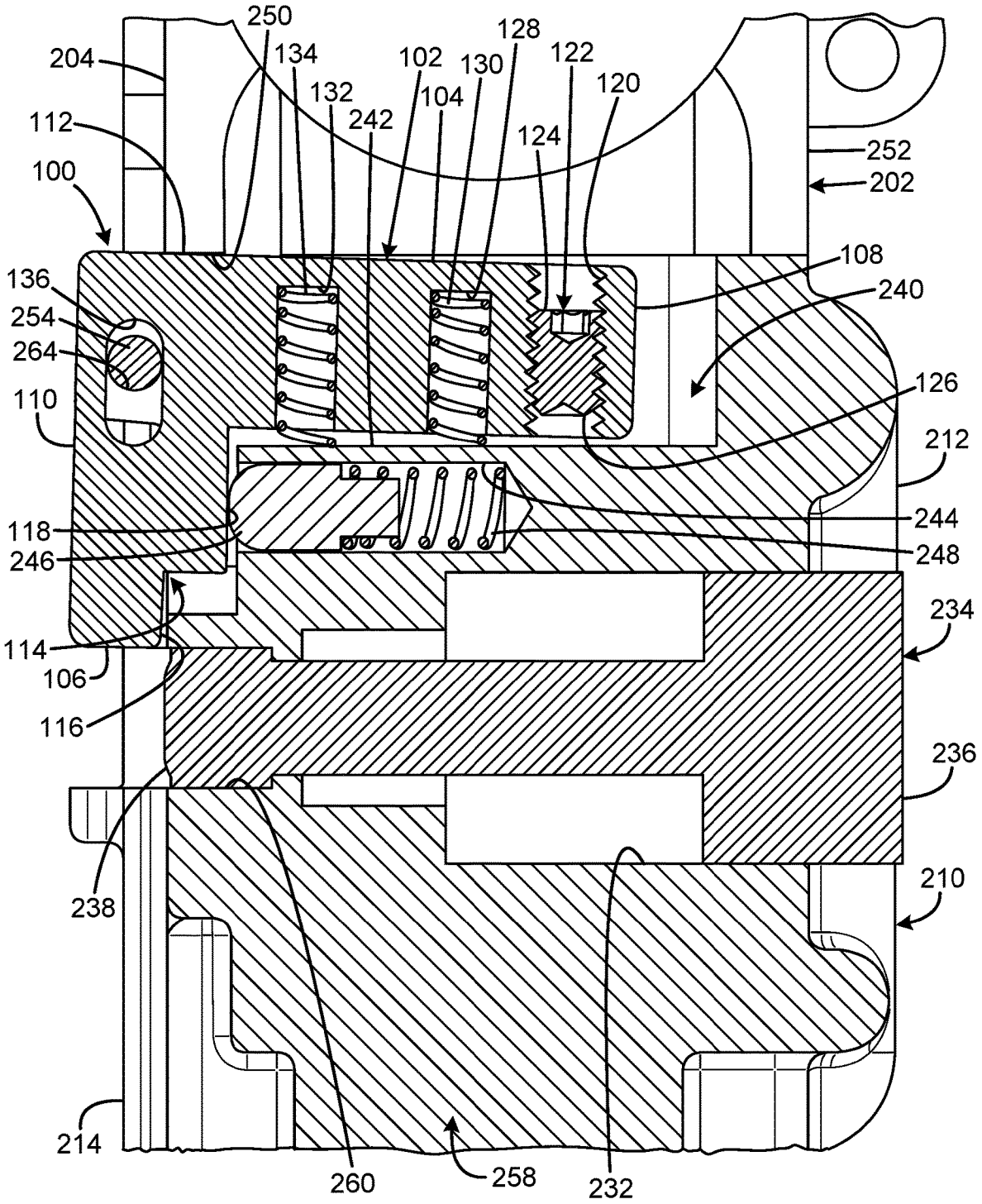
FIG. 12 is a rear sectional view of the latch for a rifle of FIG. 7 installed in a rifle with in-specification bolt hold open latch pin holes in the retention position with an improperly adjusted set screw.

FIG. 12 illustrates the improved latch for a rifle 100 of the present invention. More particularly, the latch for a rifle 100 is shown installed in a rifle 200 having in-specification bolt hold open latch pin holes 262, 264. The rifle is shown in the closed and operational assembled condition with the latch in the retention position. Contact by the bottom 250 of the left side wall 204 of the upper receiver 202 with the actuator surface 112 of the latch has pushed the latch downward and compressed the left and right springs 130, 134 against the upwardly facing surface 242 of the bolt hold open latch slot. The downward movement of the latch also causes the plunger surface 118 to push inward against plunger 246 and compress spring 248 within plunger aperture 244. However, the set screw 122 has been improperly adjusted so that the latch is not fully pushed downward into the retention position, so the block surface 116 cannot prevent movement of the magazine release 234 from the retention position to the released position by obstructing the magazine catch 238. As a result, a magazine 258 installed in the rifle can still be extracted while the rifle is in the operational assembled condition. Therefore, the set screw must be properly adjusted before the rifle can be legally used in a jurisdiction that restricts the use of detachable box magazines.

Figure 13:
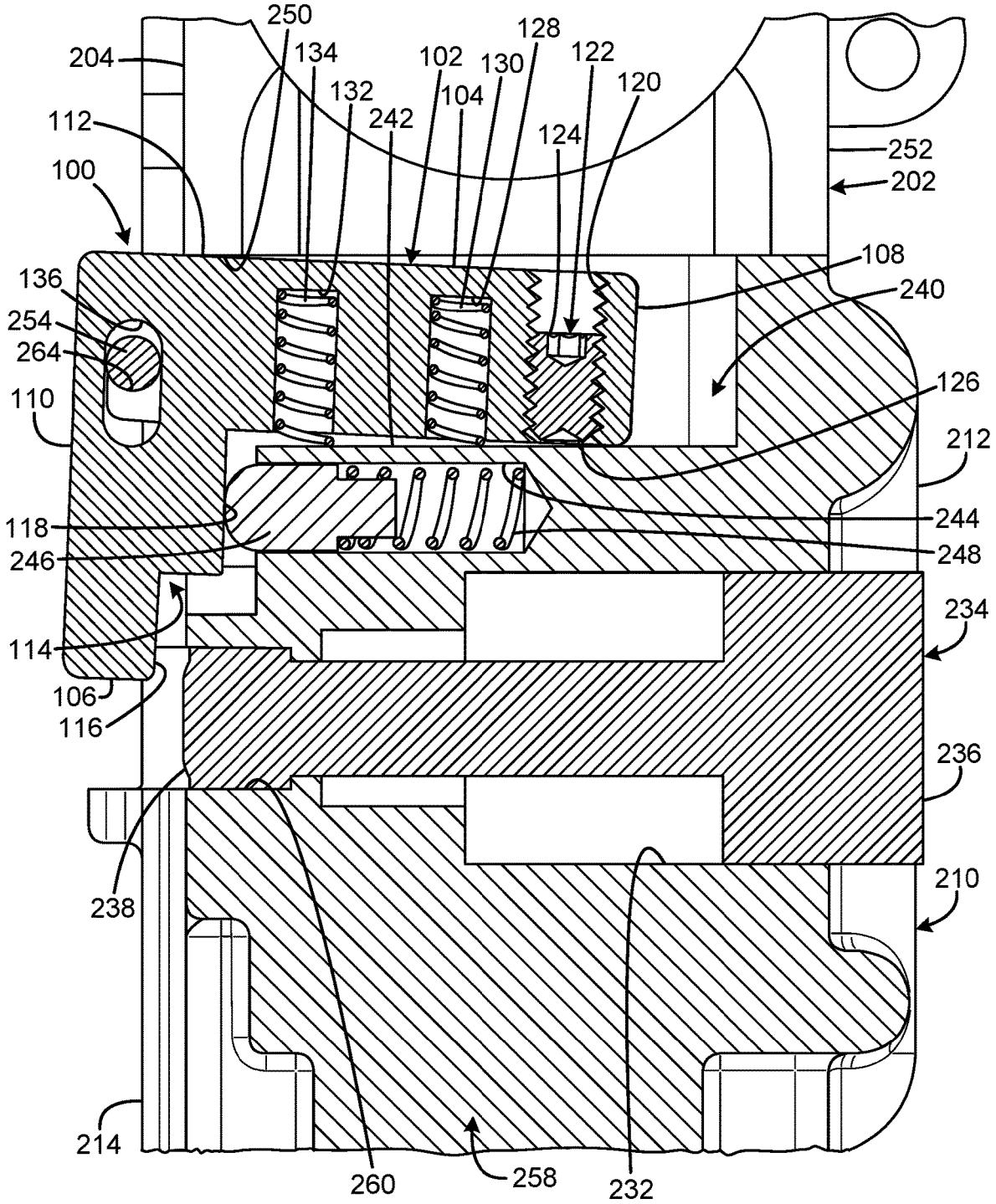
FIG. 13 is a rear sectional view of the latch for a rifle of FIG. 7 installed in a rifle with out-of-specification bolt hold open latch pin holes in the retention position with an improperly adjusted set screw.

FIG. 13 illustrates the improved latch for a rifle 100 of the present invention. More particularly, the latch for a rifle 100 is shown installed in a rifle 200 having out-of-specification bolt hold open latch pin holes 262, 264. The rifle is shown in the closed and operational assembled condition with the latch in the retention position. Contact by the bottom 250 of the left side wall 204 of the upper receiver 202 with the actuator surface 112 of the latch has pushed the latch downward and compressed the left and right springs 130, 134 against the upwardly facing surface 242 of the bolt hold open latch slot. The downward movement of the latch also causes the plunger surface 118 to push inward against plunger 246 and compress spring 248 within plunger aperture 244. However, the set screw 122 has been improperly adjusted so that the latch is not fully pushed downward into the retention position, so the block surface 116 cannot prevent movement of the magazine release 234 from the retention position to the released position by obstructing the magazine catch 238. As a result, a magazine 258 installed in the rifle can still be extracted while the rifle is in the operational assembled condition. Therefore, the set screw must be properly adjusted before the rifle can be legally used in a jurisdiction that restricts the use of detachable box magazines.

Figure 14:
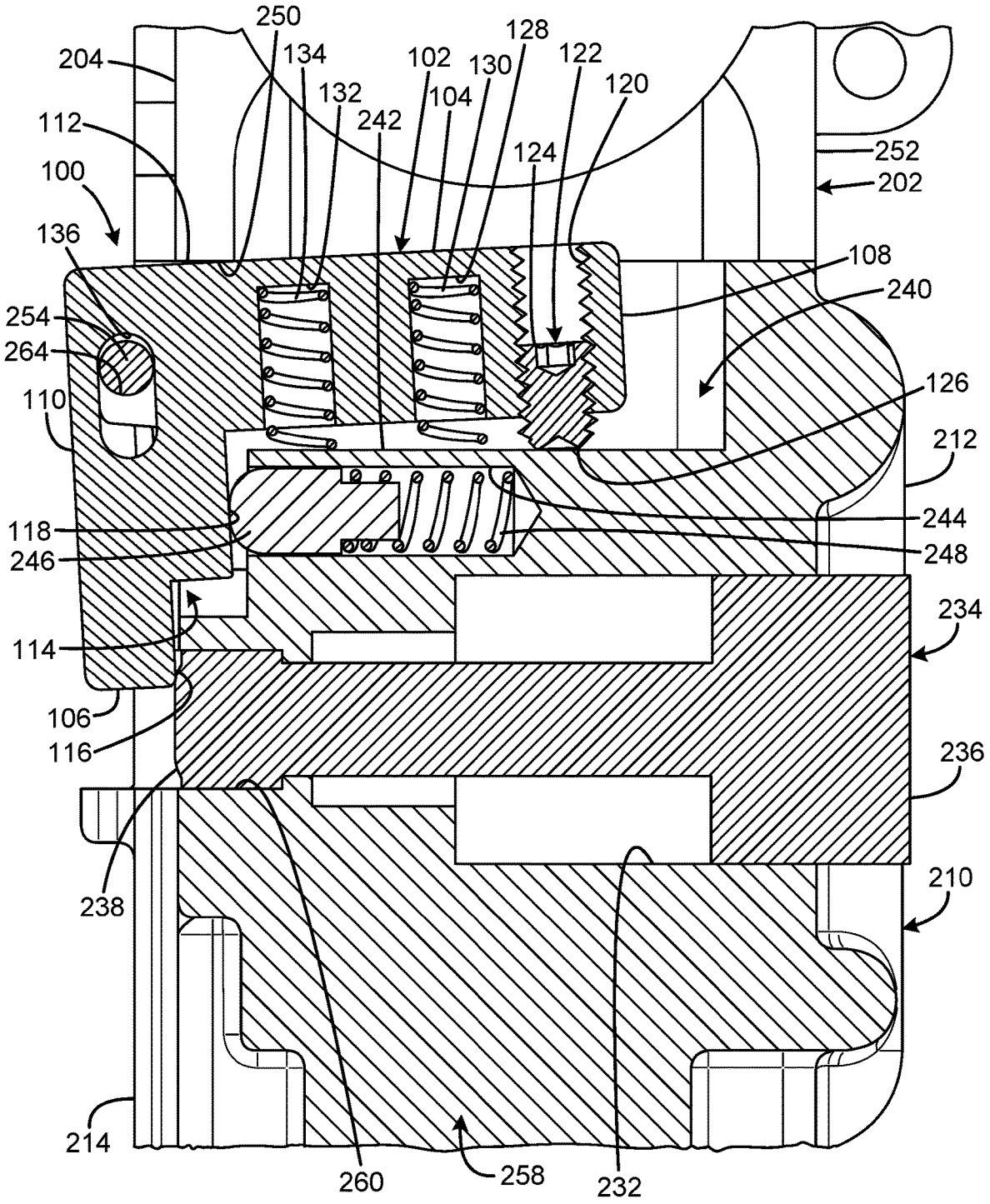
FIG. 14 is a rear sectional view of the latch for a rifle of FIG. 7 installed in a rifle with out-of-specification bolt hold open latch pin holes in the retention position with a properly adjusted set screw.

FIG. 14 illustrates the improved latch for a rifle 100 of the present invention. More particularly, the latch for a rifle 100 is shown installed in a rifle 200 having out-of-specification bolt hold open latch pin holes 262, 264. The rifle is shown in the closed and operational assembled condition with the latch in the retention position. Contact by the bottom 250 of the left side wall 204 of the upper receiver 202 with the actuator surface 112 of the latch has pushed the latch downward and compressed the left and right springs 130, 134 against the upwardly facing surface 242 of the bolt hold open latch slot. The downward movement of the latch also causes the plunger surface 118 to push inward against plunger 246 and compress spring 248 within plunger aperture 244. The set screw 122 has been properly adjusted so that when the latch is pushed downward into the retention position, the block surface 116 prevents movement of the magazine release 234 from the retention position to the released position by obstructing the magazine catch 238. As a result, a magazine 258 installed in the rifle cannot be extracted while the rifle is in the operational assembled condition because it is impossible to disengage the magazine catch from the magazine's aperture 260.

Figure 15:
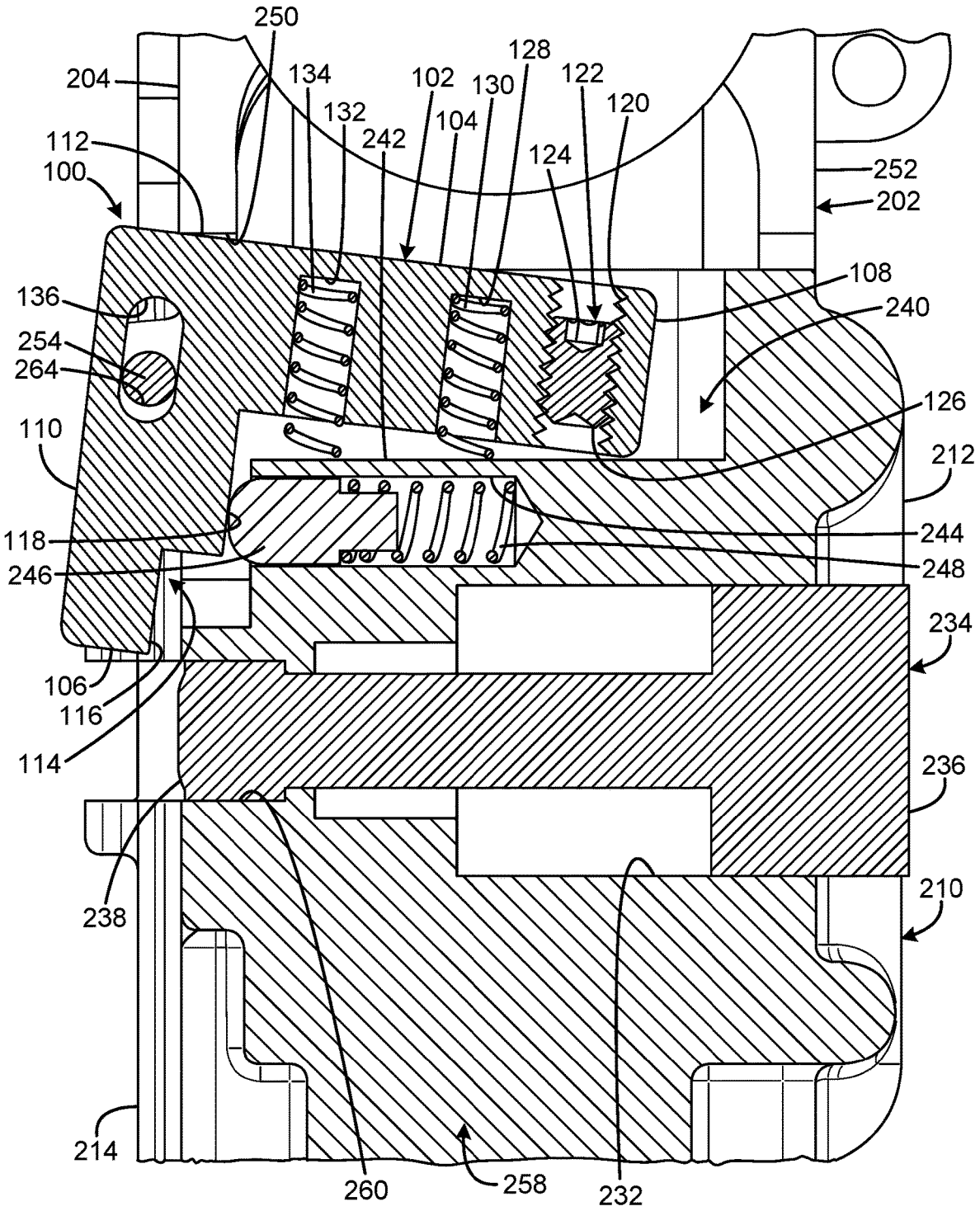
FIG. 15 is a rear sectional view of the latch for a rifle of FIG. 7 installed in a rifle with in-specification bolt hold open latch pin holes in the released position with an improperly adjusted set screw.

FIG. 15 illustrates the improved latch for a rifle 100 of the present invention. More particularly, the latch for a rifle 100 is shown installed in a rifle 200 having in-specification bolt hold open latch pin holes 262, 264. The latch for a rifle 100 is shown installed in the bolt hold open latch slot 240 of a rifle 200 with a bolt hold open latch pin 254 on the lower receiver 210 received in the elongated aperture 136. The rifle is shown in the open and inoperable separated condition with the latch in the released position. The upper receiver has been raised sufficiently to enable upward movement of the latch until contact by the bottom 250 of the left side wall 204 of the upper receiver 202 with the actuator surface 112 of the latch prevents further upward movement. The left and right springs 130, 134 have pushed against the upwardly facing surface 242 of the bolt hold open latch slot to urge the latch upward. The upward movement of the latch also causes the spring 248 to push the plunger 246 outward against plunger surface 118 to cause a clockwise pivoting of the latch about the bolt hold open latch pin. The set screw 122 has been improperly adjusted. However, when the latch is permitted to rise upward and outward into the released position, the block surface 116 no longer prevents movement of the magazine release 234 from the retention position to the released position by obstructing the magazine catch 238. As a result, a magazine 258 installed in the rifle can be extracted once the magazine catch is no longer received by the magazine's aperture 260, and a replacement magazine can be installed while the rifle is in the inoperable separated condition.

Figure 16:
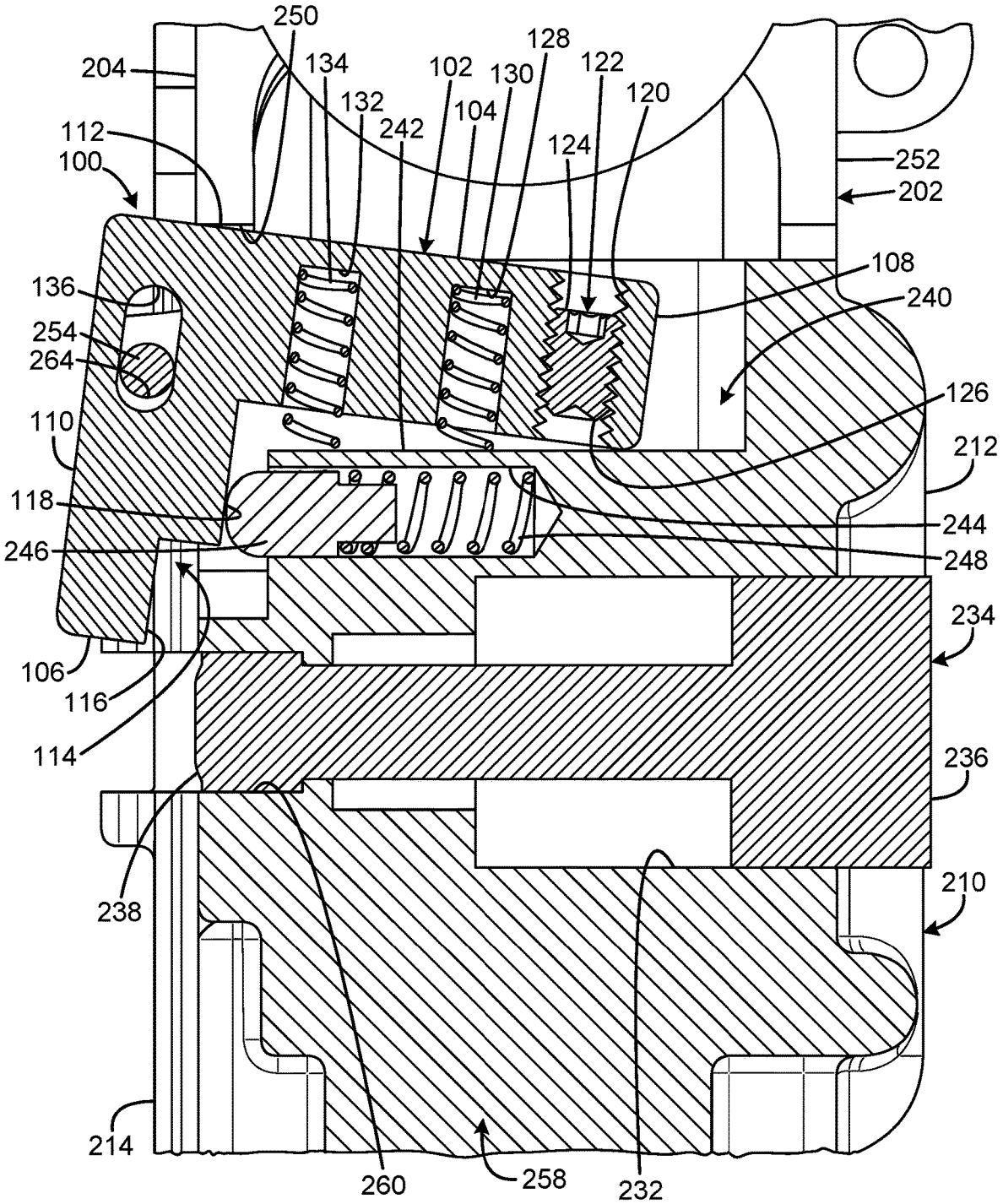
FIG. 16 is a rear sectional view of the latch for a rifle of FIG. 7 installed in a rifle with out-of-specification bolt hold open latch pin holes in the released position with an improperly adjusted set screw.

FIG. 16 illustrates the improved latch for a rifle 100 of the present invention. More particularly, the latch for a rifle 100 is shown installed in a rifle 200 having out-of-specification bolt hold open latch pin holes 262, 264. The latch for a rifle 100 is shown installed in the bolt hold open latch slot 240 of a rifle 200 with a bolt hold open latch pin 254 on the lower receiver 210 received in the elongated aperture 136. The rifle is shown in the open and inoperable separated condition with the latch in the released position. The upper receiver has been raised sufficiently to enable upward movement of the latch until contact by the bottom 250 of the left side wall 204 of the upper receiver 202 with the actuator surface 112 of the latch prevents further upward movement. The left and right springs 130, 134 have pushed against the upwardly facing surface 242 of the bolt hold open latch slot to urge the latch upward. The upward movement of the latch also causes the spring 248 to push the plunger 246 outward against plunger surface 118 to cause a clockwise pivoting of the latch about the bolt hold open latch pin. The set screw 122 has been improperly adjusted. However, when the latch is permitted to rise upward and outward into the released position, the block surface 116 no longer prevents movement of the magazine release 234 from the retention position to the released position by obstructing the magazine catch 238. As a result, a magazine 258 installed in the rifle can be extracted once the magazine catch is no longer received by the magazine's aperture 260, and a replacement magazine can be installed while the rifle is in the inoperable separated condition.

Figure 17:
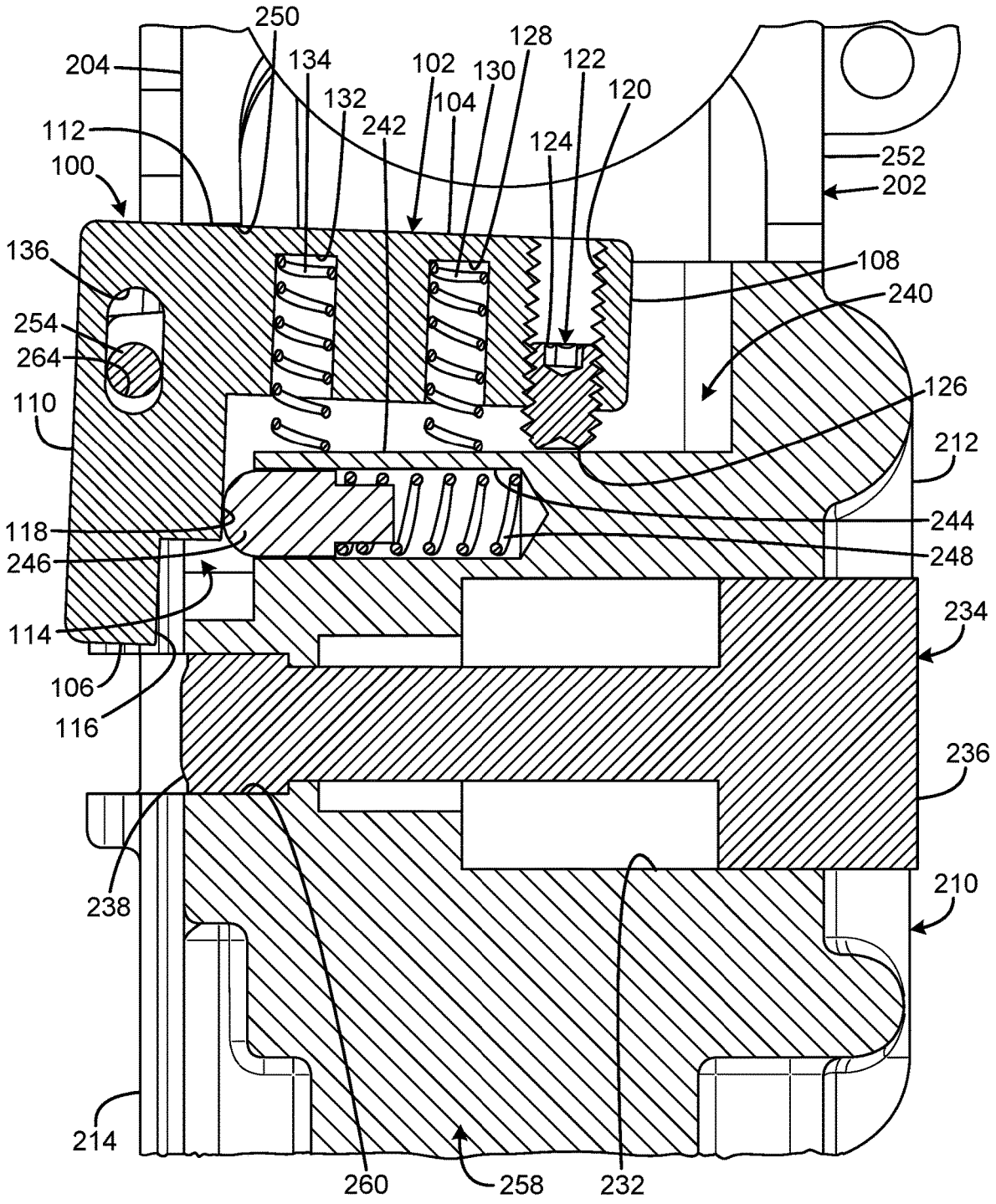
FIG. 17 is a rear sectional view of the latch for a rifle of FIG. 7 installed in a rifle with out-of-specification bolt hold open latch pin holes in the released position with a properly adjusted set screw.

FIG. 17 illustrates the improved latch for a rifle 100 of the present invention. More particularly, the rifle 100 has out-of-specification bolt hold open latch pin holes 262, 264. The latch for a rifle 100 is shown installed in the bolt hold open latch slot 240 of a rifle 200 with a bolt hold open latch pin 254 on the lower receiver 210 received in the elongated aperture 136. The rifle is shown in the open and inoperable separated condition with the latch in the released position. The upper receiver has been raised sufficiently to enable upward movement of the latch until contact by the bottom 250 of the left side wall 204 of the upper receiver 202 with the actuator surface 112 of the latch prevents further upward movement. The left and right springs 130, 134 have pushed against the upwardly facing surface 242 of the bolt hold open latch slot to urge the latch upward. The upward movement of the latch also causes the spring 248 to push the plunger 246 outward against plunger surface 118 to cause a clockwise pivoting of the latch about the bolt hold open latch pin. The set screw 122 has been properly adjusted so that when the latch is permitted to rise upward and outward into the released position, the block surface 116 no longer prevents movement of the magazine release 234 from the retention position to the released position by obstructing the magazine catch 238. As a result, a magazine 258 installed in the rifle can be extracted once the magazine catch is no longer received by the magazine's aperture 260, and a replacement magazine can be installed while the rifle is in the inoperable separated condition.

In the current embodiment, the set screw 122 is a movable adjuster element adapted to contact at least one of the upper receiver 202 and lower receiver 210 to establish a position of the block surface 116 with respect to the magazine release catch 238. This enables the operation of the latch to be fine-tuned to account for variability in the location of the bottom 250 of the left side wall 204 of the upper receiver between rifles in both the assembled and separated conditions to ensure the magazine catch is blocked by the block surface in the assembled condition and unobstructed by the block surface in the separated condition. The set screw is spaced apart from the block surface in the current embodiment. The set screw's contact surface 126 faces in a downward direction. The set screw's contact surface faces in a first direction, and the block surface faces in a second direction perpendicular to the first direction. The rifle defines a major medial plane, the magazine release catch moves on a line transverse to the major plane, and the block surface is parallel to the major medial plane.

It should be appreciated that the takedown pin for a rifle 10 and the latch 100 work in combination to speed reloading of the rifle 200 with conventional detachable box magazines while still complying with regulations in certain jurisdictions that prohibit the general public from possessing a semi-automatic firearm such as the AR-15 rifle when it is equipped with a conventional detachable box magazine that enables rapid reloading. The latch effectively equips the semi-automatic firearm with a fixed magazine that cannot be removed from the firearm unless the firearm is in an inoperable state, so the firearm is not prohibited, and is not subject to the associated legal restrictions. The takedown pin enables the rifle to be rapidly converted between an assembled condition in which the upper receiver is securely attached to abut the lower receiver and a separated condition in which the upper receiver is spaced apart from the lower receiver. As a result, only a small amount of time and a straightforward operation of the takedown pin is required by the user to transition the rifle into an inoperable condition where the magazine can be extracted and subsequently return the rifle to an operable condition where the magazine cannot be extracted. Furthermore, in the event the user is using the rifle in a jurisdiction where detachable box magazines can be used without restrictions on firearm operability during their extraction, the latch can be easily removed from the rifle to permit conventional replacement of the magazine.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a takedown pin for a rifle has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, although a takedown pin for an AR-15 variant rifle has been disclosed, it should be appreciated that the principles of the invention equally apply to a takedown pin for an AR-10 variant rifle with a few minor differences. The AR-10 takedown pin has an intermediate portion with a length of at least the lug width of 0.494" plus a tolerance of 0.012" for a total length of 0.506" just like the AR-15 take down pin. However, a takedown pin for the AR-10 is larger than that for an AR-15. So, the AR-10 takedown pin has a diameter of 0.2775", and a vertical thickness of 0.085", which is 30.6% of the diameter of the elongated portion. Also, the AR-10 takedown pin has one or more additional grooves to accommodate lower receivers where the detent pin is either in the same position as the AR-15 or located 90° from that position. The AR-10 takedown pin otherwise looks and functions in exactly the same way as the AR-15 takedown pin, so all of the features of the current invention apply equally to a version of the current invention suitable for use with an AR-10 variant rifle.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rifle comprising:

an upper receiver having a downwardly depending rear lug having a width;

the rear lug defining a transverse lug bore having a selected diameter;

a lower receiver removably attachable to the upper receiver;

the lower receiver defining an upwardly open cavity defined between opposed sidewalls;

the cavity adapted to receive the rear lug when the upper receiver is connected to the lower receiver;

the sidewalls defining lateral sidewall bores having the selected diameter;

the sidewall bores being registered with the transverse lug bore when the upper receiver and lower receiver are in a fully engaged condition;

a pin having an elongated portion received in the transverse lug bore and the sidewall bores;

the pin being movable in a direction along its length between an operating condition and a released condition;

the pin having a first end portion that, when the pin is in the operating condition, is closely received in at least one of the sidewall bores and is closely received within at least a portion of the transverse lug bore such that relative movement of the upper receiver with respect to the lower receiver is prevented;

the first end portion having a lower end portion surface adapted to resist upward movement of the rear lug;

the pin having an intermediate portion adjacent to the lower end portion surface;

the intermediate portion of the pin having a limited cross-sectional surface profile relative to the first end portion;

the intermediate portion having a widest dimension in the fore and aft direction at a level above the lower end portion; and the lower channel having a width at least as great as the width of the rear lug, such that when the pin is in the released condition, the lower channel is registered with the rear lug, and the rear lug is enabled to move upward with respect to the lower receiver by a limited distance to a disengaged position.

2. The rifle of claim 1 wherein the first end portion has a cylindrical profile.

3. The rifle of claim 1 wherein the pin has a second cylindrical end portion opposite the first end portion and having the same diameter as the first end portion.

4. The rifle of claim 1 wherein the pin is biased to the operating condition.

5. The rifle of claim 1 including a removable cap attached to the pin.

6. The rifle of claim 1 wherein the pin defines a detent channel having an operating portion adapted to engage a detent on at least one of the upper receiver and lower receiver to limit motion of the pin to reciprocation between the operating condition and the released condition.

7. The rifle of claim 6 wherein the detent channel has a transition portion connected to and perpendicular to the operating portion and adapted to enable rotation of the pin.

8. The rifle of claim 7 wherein the detent channel has a takedown portion connected to and perpendicular to the transition portion and adapted to enable extraction of the pin from the lower receiver.

9. The rifle of claim 1 wherein the intermediate portion has a length of at least 0.506".

10. The rifle of claim 1 wherein the intermediate portion has a vertical thickness less than or equal to 28.2% of the selected diameter.

11. The rifle of claim 1 wherein the intermediate portion has an upper surface coextensive with the first end portion.

12. A rifle comprising:

an upper receiver having a downwardly depending rear lug having a width;

the rear lug defining a transverse lug bore having a selected diameter;

a lower receiver removably attachable to the upper receiver;

the lower receiver defining an upwardly open cavity defined between opposed sidewalls;

the cavity adapted to receive the rear lug when the upper receiver is connected to the lower receiver;

the sidewalls defining lateral sidewall bores having the selected diameter;

the sidewall bores being registered with the transverse lug bore when the upper receiver and lower receiver are in a fully engaged condition;

a pin having an elongated portion received in the transverse lug bore and the sidewall bores;

the pin being movable in a direction along its length between an operating condition and a released condition;

the pin having a first end portion that, when the pin is in the operating condition, is closely received in at least one of the sidewall bores and is closely received within at least a portion of the transverse lug bore such that relative movement of the upper receiver with respect to the lower receiver is prevented;

the first end portion having a lower end portion surface adapted to resist upward movement of the rear lug;

the pin having an intermediate portion adjacent to the lower end portion surface;

the intermediate portion of the pin having a limited cross-sectional profile relative to the first end portion;

the intermediate portion having a widest dimension in the fore and aft direction at a level above the lower end portion; and the lower channel having a width configured to receive the width of the rear lug, such that when the pin is in the released condition, the lower channel is registered with the rear lug, and the rear lug is enabled to move upward with respect to the lower receiver by a limited distance to a disengaged position.

13. The rifle of claim 12 wherein the first end portion has a cylindrical profile.

14. The rifle of claim 12 wherein the pin has a second cylindrical end portion opposite the first end portion and having the same diameter as the first end portion.

15. The rifle of claim 12 wherein the pin is biased to the operating condition.

16. The rifle of claim 12 including a removable cap attached to the pin.

17. The rifle of claim 12 wherein the pin defines a detent channel having an operating portion adapted to engage a detent on at least one of the upper receiver and lower receiver to limit motion of the pin to reciprocation between the operating condition and the released condition.

18. The rifle of claim 17 wherein the detent channel has a transition portion connected to and perpendicular to the operating portion and adapted to enable rotation of the pin.

19. The rifle of claim 18 wherein the detent channel has a takedown portion connected to and perpendicular to the transition portion and adapted to enable extraction of the pin from the lower receiver.

20. The rifle of claim 12 wherein the intermediate portion has a length of at least 0.506".

* * * * *